US010414151B2

(12) United States Patent
Cho et al.

(10) Patent No.: US 10,414,151 B2
(45) Date of Patent: Sep. 17, 2019

(54) PRINTING APPARATUS AND METHOD OF OPERATING THE SAME

(71) Applicant: CHANGWON NATIONAL UNIVERSITY Industry Academy Cooperation Corps, Changwon-si, Gyeongsangnam-do (KR)

(72) Inventors: Young Tae Cho, Daejeon (KR); Sin Kwon, Sejong-si (KR); Taik Min Lee, Daejeon (KR)

(73) Assignee: Changwon National University Industry Academy Cooperation Corps, Gyeongsangnam-do (KR)

( * ) Notice: Subject to any disclaimer, the term of this patent is extended or adjusted under 35 U.S.C. 154(b) by 0 days.

(21) Appl. No.: 15/493,466

(22) Filed: Apr. 21, 2017

(65) Prior Publication Data

US 2017/0305143 A1 Oct. 26, 2017

(30) Foreign Application Priority Data

Apr. 22, 2016 (KR) ..... 10-2016-0049390

(51) Int. Cl.
*B41F 9/01* (2006.01)

(52) U.S. Cl.
CPC ..... *B41F 9/01* (2013.01)

(58) Field of Classification Search
CPC ..... B41F 35/00; B41F 35/002; B41F 35/006; B41F 35/02; B41F 35/04; B41F 35/06; B41F 9/01
See application file for complete search history.

(56) References Cited

U.S. PATENT DOCUMENTS 5,367,955 A * 11/1994 Hara ..... B41F 35/04 101/424
6,588,337 B1 * 7/2003 Kreckel ..... B41F 35/04 101/423
6,694,879 B2 * 2/2004 Schuster ..... B41F 35/00 101/424
6,901,859 B2 * 6/2005 Yokoyama ..... B41F 35/00 101/148
6,923,312 B2 * 8/2005 Pham ..... B41J 11/007 101/424

(Continued)

FOREIGN PATENT DOCUMENTS

KR 2010/0078255 A 7/2010
KR 2013/0109548 A 10/2013
KR 101335641 B1 12/2013

*Primary Examiner* — David H Banh
(74) *Attorney, Agent, or Firm* — Harness, Dickey & Pierce, P.L.C.

(57) ABSTRACT

Provided is a printing apparatus including: a printing roller whose outer circumferential surface is coated with ink; a cliché roller which rotates in engagement with the printing roller and forms first patterns on the printing roller by removing portions of the ink coated on the outer circumferential surface of the printing roller and on which second patterns which are the removed portions of the ink are formed; a first transfer substrate onto which the first patterns of the printing roller are transferred; and a second transfer substrate onto which the second patterns of the cliché roller are transferred. The printing apparatus can reduce the time required for a product production process by omitting a cliché cleaning process.

3 Claims, 3 Drawing Sheets

(56) References Cited

U.S. PATENT DOCUMENTS

| | | | | |
|---|---|---|---|---|
| 6,936,111 | B2 * | 8/2005 | Koppelkamm | B41F 35/06 101/416.1 |
| 2013/0277096 | A1 * | 10/2013 | Seong | C09D 11/52 174/257 |
| 2014/0000942 | A1 * | 1/2014 | Seong | B41M 3/006 174/253 |
| 2014/0017404 | A1 * | 1/2014 | Lee | H05K 3/1275 427/256 |
| 2014/0186525 | A1 * | 7/2014 | Seong | H05K 3/1275 427/123 |

* cited by examiner

[FIG. 1]
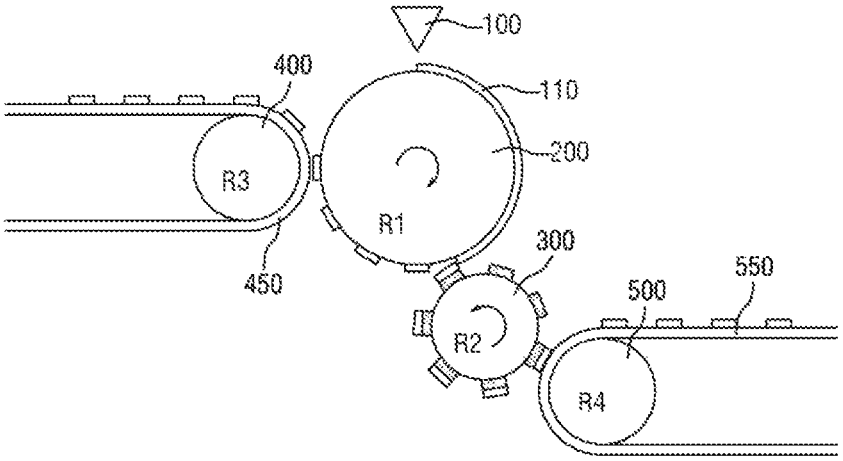
[FIG. 2]
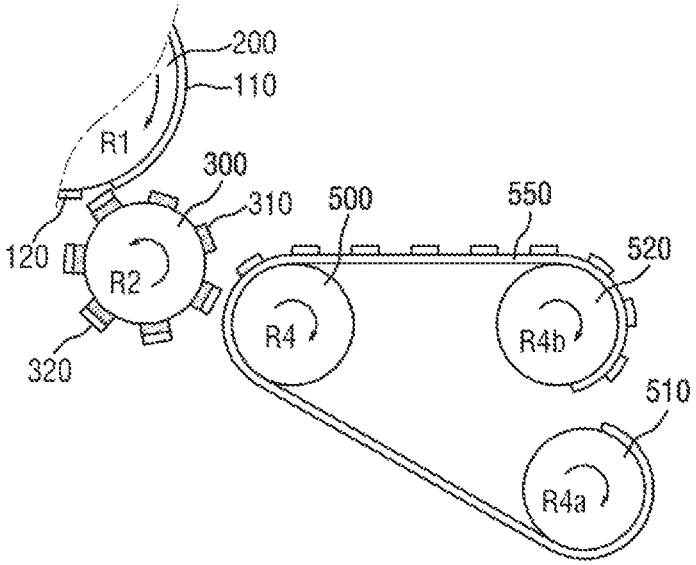

[FIG. 3]
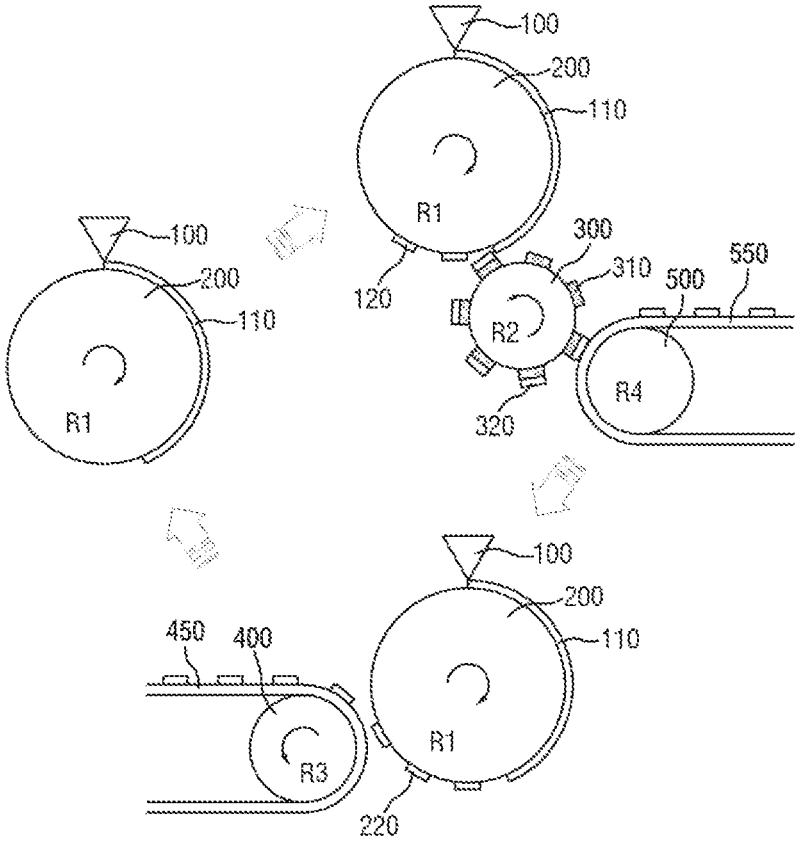

[FIG. 4]
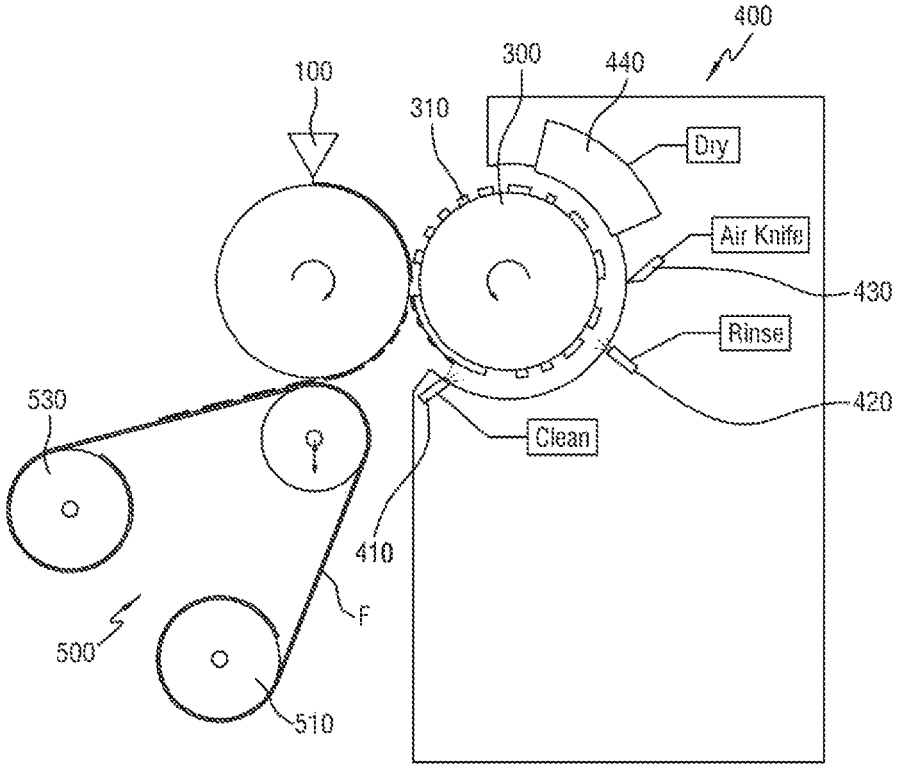

PRINTING APPARATUS AND METHOD OF OPERATING THE SAME

This application claims the benefit of Korean Patent Application No. 10-2016-0049390, filed on Apr. 22, 2016, in the Korean Intellectual Property Office, the disclosure of which is incorporated herein by reference in its entirety.

BACKGROUND

1. Field

The present inventive concept relates to a printing apparatus and a method of operating the same, and more particularly, to a printing apparatus which omits a cliché cleaning operation from a reverse off-set printing process and a method of operating the printing apparatus.

2. Description of the Related Art

Most semiconductors and electronic products are manufactured in an environment where expensive equipment or advanced process technologies are utilized. In particular, there is a limitation in reducing the manufacturing cost of a target product due to the cost of repeatedly performing the process of removing or deforming a material to form a thin film on a substrate which is the material of a transparent electronic film. Therefore, it is necessary to reduce material cost and process cost in related industries.

In addition, a conventional method of producing a product according to a patterning process is not suitable for mass production because productivity is not high due to complexity of a production process due to, e.g., etching.

As an exemplary embodiment of electronic printing technology that has been developed for the production of the above semiconductors and electronic products, a roll-to-roll (R2R) printing process capable of mass-producing low-priced products is attracting attention. The R2R process is a manufacturing process accomplished by transferring and printing ink onto a substrate using a roller engraved with a circuit. Unlike a conventional process of producing an electronic product, the R2R process applies the technology of printing general printed matter such as newspapers and magazines to manufacture electronic products.

The R2R process is a method essentially used in the process of producing products such as E-paper and materials of displays (e.g., flexible displays).

A reverse off-set printing process is a process in which a printing roller is coated with ink, patterns that are not to be printed are taken off using a cliché roller, and the remaining patterns are transferred to a substrate.

To transfer ink onto a film by applying the reverse off-set printing process, patterns that are not to be printed may be removed from a printing roller using a cliché roller by transferring part of ink coated on the printing roller to embossed protrusions formed on an outer surface of the cliché roller. However, since the ink patterns transferred from the printing roller to the cliché roller remain on the embossed protrusions of the cliché roller, it is difficult to take off ink coated on the printing roller using the cliché roller in a process according to a next cycle.

Therefore, the ink transferred to the cliché roller should be removed through a cleaning process. This is a very important process for a next process. If the ink transferred to the cliché roller is not removed, there is a high possibility that when part of ink coated on the printing roller is removed from the printing roller, it will not be completely removed due to the ink remaining on the cliché roller.

In addition, the lifetime of the cliché roller can be shortened due to the continuously transferred ink. Therefore, if the reverse off-set printing process is applied to the continuous R2R process, the process of cleaning the cliché roller must be performed.

FIG. 4 is a schematic view of a conventional R2R printing apparatus. Referring to FIG. 4, the R2R printing apparatus includes a doctor blade 100 which provides conductive ink, a printing roller 200 whose outer circumferential surface is coated by rotation with the conductive ink provided by the doctor blade 100, a cliché roller 300 which rotates in engagement with the printing roller 200 and removes portions of the conductive ink coated on the outer circumferential surface of the printing roller 200 to form shapes corresponding to predetermined patterns on the outer circumferential surface of the printing roller 200, a cleaning device 400 which is provided adjacent to an outer circumferential surface of the cliché roller 300 to clean the portions of the conductive ink removed from the outer circumferential surface of the printing roller 200 by the cliché roller 300, and a film roller unit 500 which has a film F to be patterned on an outer circumferential surface and rotates in engagement with the printing roller 200 to continuously transfer patterns formed on the outer peripheral surface of the printing roller 200 to the film F.

Since the conventional R2R apparatus performs the cleaning process, the process time is increased as compared with a case where the cleaning process is not performed, leading to a reduction in the production of products. In addition, since additional raw materials or equipment are required for the cleaning process, the cost of installing or maintaining additional equipment can be incurred.

SUMMARY

Aspects of the inventive concept provide a printing apparatus which can omit a cliché cleaning operation when performing a reverse off-set printing process.

However, aspects of the inventive concept are not restricted to the one set forth herein. The above and other aspects of the inventive concept will become more apparent to one of ordinary skill in the art to which the inventive concept pertains by referencing the detailed description of the inventive concept given below.

According to an aspect of the inventive concept, there is provided a printing apparatus including: a printing roller whose outer circumferential surface is coated with ink; a cliché roller which rotates in engagement with the printing roller and forms first patterns on the printing roller by removing portions of the ink coated on the outer circumferential surface of the printing roller and on which second patterns which are the removed portions of the ink are formed; a first transfer substrate onto which the first patterns of the printing roller are transferred; and a second transfer substrate onto which the second patterns of the cliché roller are transferred.

In addition, the cliché roller may further include embossed portions which are protrusions formed on an outer circumferential surface of the cliché roller, wherein the second patterns are located on outer surfaces of the embossed portions, respectively.

In addition, the apparatus may further include: a feeding roller which feeds the second transfer substrate; an impression roller which rotates in engagement with the cliché roller such that the second patterns are formed on the second transfer substrate fed by the feeding roller; and a collecting roller which winds the second transfer substrate having the second patterns formed as the second transfer substrate passes through the impression roller.

According to another aspect of the inventive concept, there is provided a method of operating a printing apparatus. The method includes: receiving ink from a slit nozzle and forming an ink layer by evenly coating the ink on a blanket which covers an outer circumferential surface of a printing roller; transferring part of the ink coated on the printing roller to a cliché roller through rotation and transferring first patterns, which are ink patterns remaining on the printing roller, to a first transfer substrate; and transferring second patterns, which are ink patterns transferred to the cliché roller, to a second transfer substrate.

BRIEF DESCRIPTION OF THE DRAWINGS

These and/or other aspects will become apparent and more readily appreciated from the following description of the embodiments, taken in conjunction with the accompanying drawings in which:

FIG. 1 is a schematic view of a printing apparatus according to an embodiment;

FIG. 2 is an enlarged view of a cliché roller included in the printing apparatus of FIG. 1;

FIG. 3 is a schematic diagram illustrating an off process and a set process of the printing apparatus of FIG. 1; and FIG. 4 is a schematic view of a conventional apparatus for performing a reverse off-set printing process.

DETAILED DESCRIPTION

Advantages and features of the present inventive concept and methods of accomplishing the same may be understood more readily by reference to the following detailed description of exemplary embodiments and the accompanying drawings. The inventive concept may, however, be embodied in many different forms and should not be construed as being limited to the embodiments set forth herein. Rather, these embodiments are provided so that this disclosure will be thorough and complete and will fully convey the concept of the invention to those skilled in the art, and the inventive concept will only be defined by the appended claims. Like reference numerals refer to like elements throughout the specification.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated components, but do not preclude the presence or addition of one or more other components.

It will be understood that, although the terms first, second, third, etc., may be used herein to describe various components, these components should not be limited by these terms. These terms are only used to distinguish one component from another component. Thus, a first component discussed below could be termed a second component without departing from the teachings of the inventive concept.

Hereinafter, embodiments of the inventive concept will be described in detail with reference to the accompanying drawings.

In general, a reverse off-set printing process is a process in which a blanket roll is coated with ink, certain patterns are transferred from the blanket roll to a roll cliché, and then patterns remaining on the blanket roll are transferred to a substrate. In the reverse off-set printing process, fine patterns of several μm in size can be transferred.

Here, if the substrate is of a roll type, the reverse off-set printing process can be named as a roll-to-roll (R2R) printing process because patterns are transferred from the blanket roll to the roll-type substrate.

Generally, patterns transferred from the blanket roll to the roll cliché, that is, ink transferred to an outer surface of the roll cliché should be removed using a blade or should be removed using a cleaning device.

Therefore, since a cleaning process is performed in the general reverse off-set printing process, the process time is increased as compared with a case where the cleaning process is not performed, leading to a reduction in the production of products. In addition, since additional raw materials or equipment are required for the cleaning process, the cost of installing or maintaining additional equipment can be incurred.

In this regard, the inventive concept provides a reverse off-set printing apparatus which can reduce the time required for a product production process by omitting a cliché cleaning process.

A printing apparatus according to the inventive concept will now be described in greater detail.

FIG. 1 is a schematic view of a printing apparatus according to an embodiment. FIG. 2 is an enlarged view of a cliché roller 300 included in the printing apparatus of FIG. 1. FIG. 3 is a schematic diagram illustrating an off process and a set process of the printing apparatus of FIG. 1.

Of reference characters illustrated in FIGS. 1 through 3. R1 indicates a printing roller 200, R2 indicates the cliché roller 300, R3 indicates a press roller 400, R4 indicates an impression roller 500, R4*a* indicates a feeding roller 510, and R4*b* indicates a collecting roller 520.

Referring to FIG. 1, the printing apparatus according to the embodiment includes the printing roller 200 whose outer circumferential surface is coated with ink, the cliché roller 300 which rotates in engagement with the printing roller 200 and forms first patterns 120 on the printing roller 200 by removing portions of the ink coated on the outer circumferential surface of the printing roller 200 and on which second patterns 320 which are the removed portions of the ink are formed, a first transfer substrate 450 onto which the first patterns 120 of the printing roller 200 are transferred, and a second transfer substrate 550 onto which the second patterns 320 of the cliché roller 300 are transferred.

Referring to FIG. 2, the printing apparatus according to the embodiment may further include the feeding roller 510 which feeds the second transfer substrate 550, the impression roller 500 which rotates in engagement with the cliché roller 300 such that the second patterns 320 are formed on the second transfer substrate 550 fed by the feeding roller 510, and the collecting roller 520 which winds the second transfer substrate 550 having the second patterns 320 formed as the second transfer substrate 550 passes through the impression roller 500.

The printing roller 200 is a roller coated with ink, and a surface of the printing roller 200 is covered with a rubber blanket.

The printing roller 200 may perform an ink coating process in which ink provided by a slit nozzle 100 placed above the printing roller 200 is applied to the outer circumferential surface of the printing roller 200.

The ink coating process is performed to apply ink to the outer circumferential surface of the printing roller 200. An edge portion (not illustrated) may be provided at a lower part of the slit nozzle 100 and may be brought into contact with the outer circumferential surface of the rotating printing roller 200 to apply conductive ink to the outer circumferential surface of the printing roller 200 while scraping off the ink to form a flat ink layer 110.

The cliché roller 300 rotates in engagement with the printing roller 200 and includes embossed portions 310 in the shape of predetermined patterns.

The embossed portions 310 may separate some ink from the ink layer 110 coated on the outer circumferential surface of the printing roller 200 to form shapes corresponding to predetermined patterns on the outer circumferential surface of the printing roller 200.

That is, the embossed portions 310 of the cliché roller 300 may rotate in engagement with the printing roller 200 and form the first patterns 120 on the printing roller 200 by removing portions of the ink provided on the outer circumferential surface of the printing roller 200.

In addition, the removed portions of the ink are formed on upper surfaces of the embossed portions 310, respectively. That is, in the inventive concept, the second patterns 320 are formed on the upper surfaces of the embossed portions 310, respectively.

The first patterns 120 formed on the printing roller 200 may be transferred to the first transfer substrate 450 as they are rotated and brought into contact with the first transfer substrate 450.

Here, in the inventive concept, the second patterns 320 formed on the cliché roller 300, that is, the embossed portions 310 may be transferred to the second transfer substrate 550 as they are rotated and brought into contact with the second transfer substrate 550.

As described above, in the general reverse off-set printing process, ink, that is, patterns transferred onto an outer surface of a cliché roller should be removed using a blade or should be removed using a cleaning device and then taken off.

In the inventive concept, however, since the second patterns 320 formed on the cliché roller 300, i.e., the embossed portions 310 are transferred to the separate second transfer substrate 550, a cliché cleaning process is omitted. This can reduce the time required for a product production process.

Each of the first transfer substrate 450 and the second transfer substrate 550 may be a transparent inorganic material such as quartz or glass having transparency or any one transparent plastic material such as polyethylene terephthalate (PET), polyethylene naphthalate (PEN), polycarbonate (PC), polystyrene (PS), polypropylene (PP), polyimide (PI), polyethylene sulfonate (PES), polyoxymethylene (POM), polyether ether ketone (PEEK), polyethersulfone (PES), or polyetherimide (PEI). However, the types of the first transfer substrate 450 and the second transfer substrate 550 are not limited.

The first transfer substrate 450 may be disposed on an outer circumferential surface of the press roller 400, and the press roller 400 may be in contact with the printing roller 200 to transfer the first patterns 120 from the printing roller 200 to the first transfer substrate 450.

The first transfer substrate 450 may be fed to and withdrawn from the press roller 400 through a feeding line (not illustrated) and a collecting line (not illustrated), and the feeding line and the collecting line may be configured in the form of winding rollers, like the feeding roller 510 and the collecting roller 550.

The process of transferring the second patterns 320 from the cliché roller 300 to the second transfer substrate 550 according to the inventive concept will now be described in detail.

As illustrated in FIG. 2, the embossed portions 310 in the shape of the second patterns 320 may be located on an outer circumferential surface of the cliché roller 300, and the second patterns 320 may be formed on the upper surfaces of the embossed portions 310.

That is, as described above, the cliché roller 300 may rotate in contact with the printing roller 200 to form the first patterns 120 on the outer circumferential surface of the printing roller 200 by transferring predetermined patterns from the ink layer 110 coated on the outer circumferential surface of the printing roller 200. In addition, the cliché roller 300 may form the second patterns 320 on the embossed portions 310.

The second patterns 320 transferred to the embossed portions 310 of the cliché roller 300 may rotate half a cycle as the cliché roller 300 rotates. Then, the second patterns 320 may be transferred to the second transfer substrate 550 as they are brought into contact with the second transfer substrate 550.

The second transfer substrate 550 before the second patterns 320 are transferred may be wound around the feeding roller 510.

In addition, the second transfer substrate 550 may be disposed on an outer circumferential surface of the impression roller 500, and the impression roller 500 may be in contact with the cliché roller 300 to transfer the second patterns 320 from the cliché roller 300 to the second transfer substrate 550. The second transfer substrate 550 to which the second patterns 320 have been transferred from the cliché roller 300 may be wound around the collecting roller 520 and stored for a next process.

The operation of the printing apparatus according to the inventive concept will now be described.

Referring to FIG. 3, a method of operating an R2R printing apparatus according to an embodiment includes receiving ink from a nozzle and forming an ink layer by evenly coating the ink on a blanket which covers an outer circumferential surface of a printing roller; transferring part of the ink coated on the printing roller to a cliché roller through rotation and transferring first patterns, which are ink patterns remaining on the printing roller, to a first transfer substrate; and transferring second patterns, which are ink patterns transferred to the cliché roller, to a second transfer substrate.

More specifically, the slit nozzle 100 positioned above the printing roller 200 may form the ink layer 110 by applying ink to the blanket formed on the outer surface of the printing roller 200. The ink layer 110 may be evenly coated on the outer surface of the printing roller 200 as the printing roller 200 rotates.

The ink layer 110 evenly coated on the outer surface of the printing roller 200 may become adjacent to the cliché roller 300 as the printing roller 200 rotates. The cliché roller 300 may separate portions of the ink layer 110 formed on the printing roller 200 and transfer the separated portions to the embossed portions 310 formed on an outer surface of the cliché roller 300. This process is called an off process.

The first patterns 120 which are the portions separated from the ink layer 110 by the cliché roller 300 in the off process may be transferred to the first transfer substrate 450 formed on an outer surface of the press roller 400 as the printing roller 200 rotates. This process is called a set process.

That is, in the off process and the set process, the first patterns 120 may be transferred to the first transfer substrate 450.

During the off process and the set process, the second patterns 320 formed on outer surfaces of the embossed portions 310 of the cliché roller 300 may be transferred to the second transfer substrate 550 formed on an outer surface of the impression roller 500, as illustrated in FIG. 2.

Since this process is the same as described above, a detailed description of the process will be omitted.

That is, in the inventive concept, the first patterns 120 formed on the printing roller 200 are transferred to the first transfer substrate 450, and the second patterns 320 formed on the cliché roller 300 are transferred to the second transfer substrate 550. The two processes of transferring the first patterns 120 and the second patterns 320 respectively onto the first transfer substrate 450 and the second transfer substrate 550 can be performed simultaneously within one apparatus, and patterns can be formed on the first transfer substrate 450 and the second transfer substrate 550 without the need to clean the cliché roller 300.

In the inventive concept, the first patterns 120 formed on the first transfer substrate 450 can be used to form desired patterns. Also, the second patterns 320 formed on the second transfer substrate 550 can be used to form desired patterns.

That is, according to the inventive concept, the first patterns 120 formed on the first transfer substrate 450 can be used as a layer formed on a substrate, and the second patterns 320 formed on the second transfer substrate 550 can be used as a layer formed on a substrate. Therefore, patterns can be simultaneously formed on two substrates with no discarded ink.

In the inventive concept, the time required for a product production process can be reduced by omitting a cliché cleaning process.

In addition, the production of products can be increased by forming a plurality of printing patterns, unlike conventional technology that forms a single printing pattern.

However, the effects of the inventive concept are not restricted to the one set forth herein. The above and other effects of the inventive concept will become more apparent to one of daily skill in the art to which the inventive concept pertains by referencing the claims.

While the inventive concept has been particularly illustrated and described with reference to exemplary embodiments thereof, it will be understood by those of ordinary skill in the art that various changes in form and detail may be made therein without departing from the spirit and scope of the inventive concept as defined by the following claims. The exemplary embodiments should be considered in a descriptive sense only and not for purposes of limitation.

What is claimed is:

1. A printing apparatus comprising:
- a printing roller whose outer circumferential surface is coated with ink;
- a cliché roller configured to rotate in engagement with the printing roller and to form first patterns on the printing roller by removing portions of the ink coated on the outer circumferential surface of the printing roller and on which second patterns which are the removed portions of the ink are formed;
- a first transfer substrate onto which the first patterns of the printing roller are transferred;
- a second transfer substrate onto which the second patterns of the cliché roller are transferred; wherein
  - desired first patterns are formed by the first patterns; and
  - desired second patterns are formed by the second patterns;
- a first collecting roller configured to wind the first transfer substrate and maintain the desired first patterns; and
- a second collecting line configured to wind the second transfer substrate and maintain the desired second patterns.

2. The apparatus of claim 1, wherein the cliché roller further comprises embossed portions which are protrusions formed on an outer circumferential surface of the cliché roller, wherein the second patterns are located on outer surfaces of the embossed portions, respectively.

3. A method of operating a printing apparatus, the method comprising:
- receiving ink from a slit nozzle and forming an ink layer by evenly coating the ink on a blanket which covers an outer circumferential surface of a printing roller;
- transferring part of the ink coated on the printing roller to a cliché roller through rotation and transferring first patterns, which are ink patterns remaining on the printing roller, to a first transfer substrate; and
- transferring second patterns, which are ink patterns transferred to the cliché roller, to a second transfer substrate; wherein
  - desired first patterns are formed by the first patterns; and
  - desired second patterns are formed by the second patterns, the desired first and second patterns being a layer in an electronic device.

* * * * *